US006224077B1

(12) United States Patent
Sheng

(10) Patent No.: US 6,224,077 B1
(45) Date of Patent: May 1, 2001

(54) LINK LIFTING GEAR FOR A BABY-WALKER

(76) Inventor: Cherng-Yuh Sheng, 1F, No. 16-5, Chin Hu Rd., Nei-hu Dist., Taipei (TW)

( * ) Notice: Subject to any disclaimer, the term of this patent is extended or adjusted under 35 U.S.C. 154(b) by 0 days.

(21) Appl. No.: 09/262,273

(22) Filed: Mar. 4, 1999

(51) Int. Cl.[7] ..... B62B 7/00
(52) U.S. Cl. ..... 280/87.051; D12/130
(58) Field of Search ..... 280/87.051, 87.03, 280/827; D12/130

(56) References Cited

U.S. PATENT DOCUMENTS 517,403 * 3/1894 Bradish ..... 280/87.03
4,433,869 * 2/1984 Payne, Jr. et al. ..... 297/5
4,576,392 * 3/1986 Quinlan, Jr. ..... 280/87.051
5,324,064 * 6/1994 Sumser et al. ..... 280/649
5,351,978 * 10/1994 Chen ..... 280/87.051
5,564,724 * 10/1996 Huang ..... 280/87.051
5,820,527 * 10/1998 Lai ..... 482/68
6,048,290 * 4/2000 Chen et al. ..... 482/68

* cited by examiner

*Primary Examiner*—J. J. Swann
*Assistant Examiner*—James S. McClellan
(74) *Attorney, Agent, or Firm*—Harrison & Egbert

(57) ABSTRACT

A baby walker having a chassis, a bracket table, and a lifting gear for elevating the bracket table relative to the chassis. The lifting gear includes two pairs of parallel links, each having one end pivotally attached by a shaft bin to the chassis and an opposite end pivotally attached by a shaft bin to the bracket table. Each of the pair of parallel links includes a first link, a second link, a secured wedge piece fixed onto the first link, a slide having a rod slot slidably affixed to the second link and a locking gear positioned between the first and second links so as to control a distance between the first and second links so as to control a height of the bracket table with respect to the chassis.

2 Claims, 5 Drawing Sheets

LINK LIFTING GEAR FOR A BABY-WALKER

BACKGROUND OF THE INVENTION

A baby walker is a kind of children's apparatus having an upper frame (bracket table) and a lower frame (chassis) with wheels. A baby seat is hung under the bracket table. The conventional baby walker has no height-adjustment mechanism and its height can be adjusted only by the stepped sections on the seat frame. As people's living standards are improved, they demand a height-adjustment mechanism (the lifting gear) for a baby walker which not only fits the height of each baby but also adjusted to the the growth of a baby. Some conventional baby walkers use a crossed rod support for a height adjustment gear which can control the included angle of the cross-rod by means of a ratchet down slot under the bracket table to position and control the height of the baby walker.

PRIOR ART OF THE INVENTION

A conventional baby walker either has no lifting gear for its bracket table or has only a stepped section on the seat frame to adjust the height of the seat for a baby.

FIELD OF THE INVENTION

A link lifting gear for a baby walker relates to a gear which has a pair of links controlled by a wedge, a slide and a spring to change the distance between the two links so as to adjust the height of the baby walker.

DETAILED DESCRIPTION OF THE PREFERRED EMBODIMENT

Figure 1:
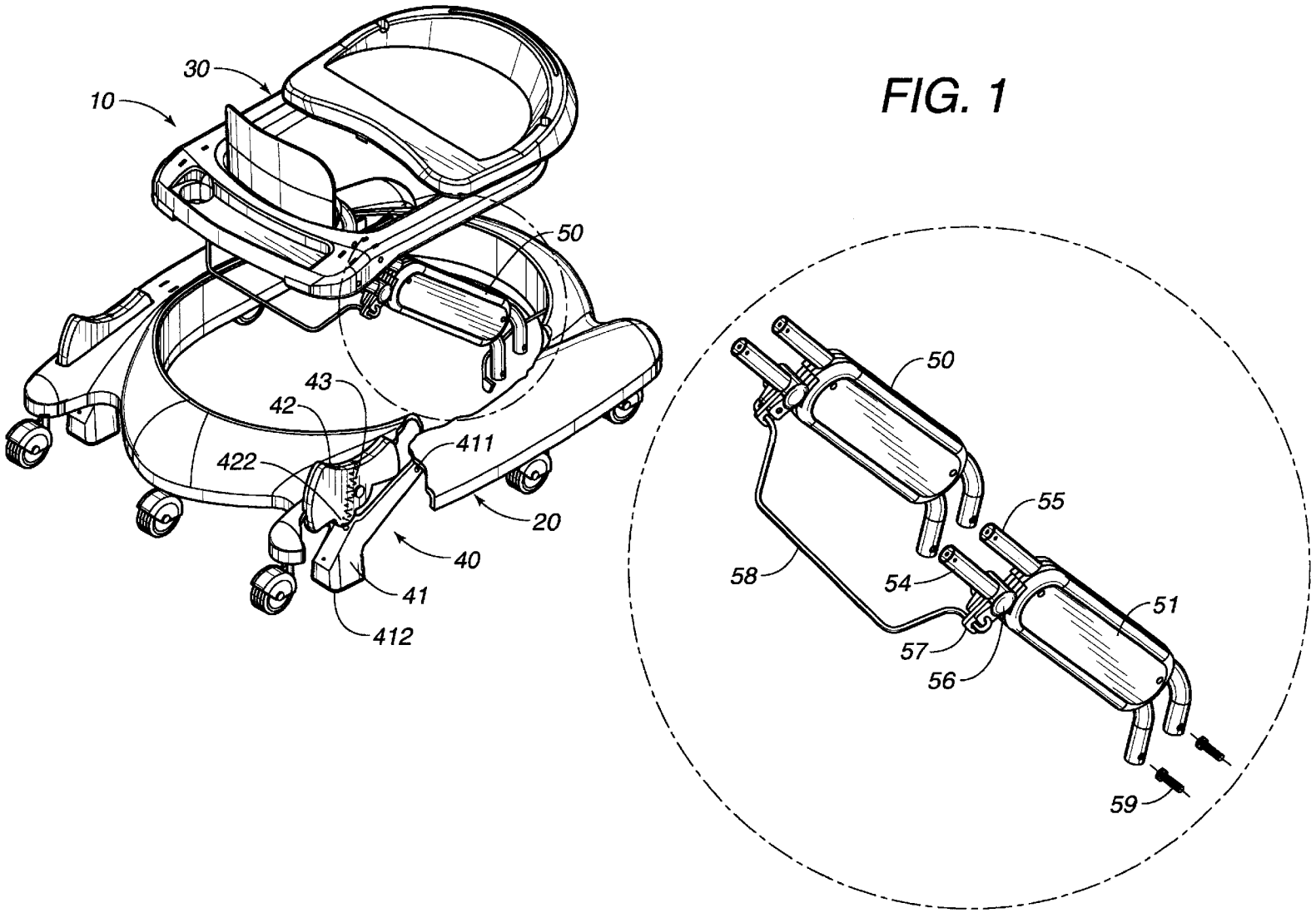
FIG. 1 is a schematic view of the invention fixed on the baby walker.

As shown in FIG. 1, a baby walker (10) has a chassis (20), a bracket table (30), a brake gear (40), and a lifting gear (50). The the brake gear (40) is fixed on the chassis (20), using a pair of supports (41) on respective sides to stand on the ground and make a portion of the wheel leave the ground so as to position the baby walker (10) and prevent it from moving or gliding. A a shaft (411) at the front end of the support (41) is pivoted on the chassis (20). The middle section of the support is controlled by a button (42) on the support (41). The button (42) has a shaft hole in either side of the button (42) for the shaft (411) to pivot on the chassis (20). The button (42) and has a cam (422) at its lower middle portion. A spring (43) is used to fasten and link the button (42) and the support (41). When the button (42) is pressed back, the cam (422) pushes the support (41) away and makes the foot rest (412) stand on the ground. When the button (42) is pressed forward, the support (41) is pulled up near the button (42) and the foot rest (412) will leave the ground.

This invention particularly refers to a lifting gear (50) between the chassis (20) and the bracket table (30). It has a function to adjust the height of the bracket table (30) to fit the height of a baby. This lifting gear (50), as shown in FIG. 1, has two pairs of parallel links (54) used as a frame, and a slide (51) and a lock catch for brake are fixed on the parallel links and a draw bar (58) is used to control the brake so as to release or tension the lock catch. A pair of shaft pins (59) either at the upper or lower end of each link are used to pivot the parallel links on the bracket table (30) and chassis (20) so that the bracket table (30) can be maintained in a horizontal orientation when it is lifted or lowered.

Figure 2:
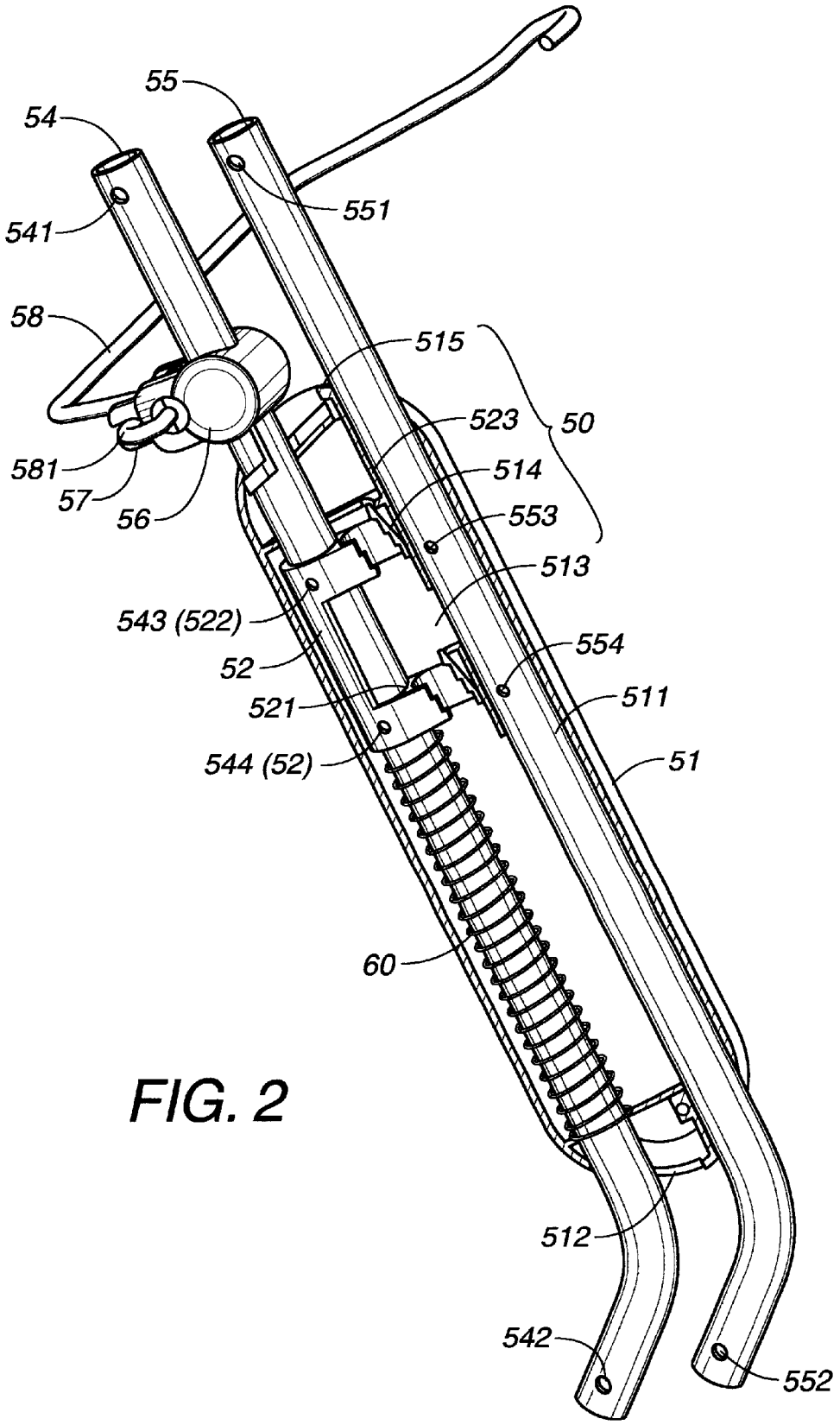
FIG. 2 is a sectional view of a partial assembly of the invention.

As shown in FIG. 2, a slide (51) shaped like a cover body has two symmetric sides, and only one side of the slide (51) is shown in FIG. 2. The slide (51) has a pair of parallel rod slots (511, 512). The diameter of the rod slot (511) is as large as the diameter of the link (55) so that the slide (51) can move and glide on the link (55). The sectional phase of the rod slot (512) tends to be an elongated hole which allows the slide (51) to glide on the link (54) and to accommodate the distance and the differential motion resulting from the change of oscillation range and angle between the two links (54, 55). Along the rod slot (512) in the slide (51) there is disposed a slant slot (513) to accommodate a slant piece (52) so that the slant piece (52) can move in the slant slot (513). The slant piece (52) has a rod hole (521) to set in the link (54). The slant piece (52) has a pair of pin holes (522, 523). The slant piece (52) and the link (54) are combined into one body by means of a pin.

Figure 3:
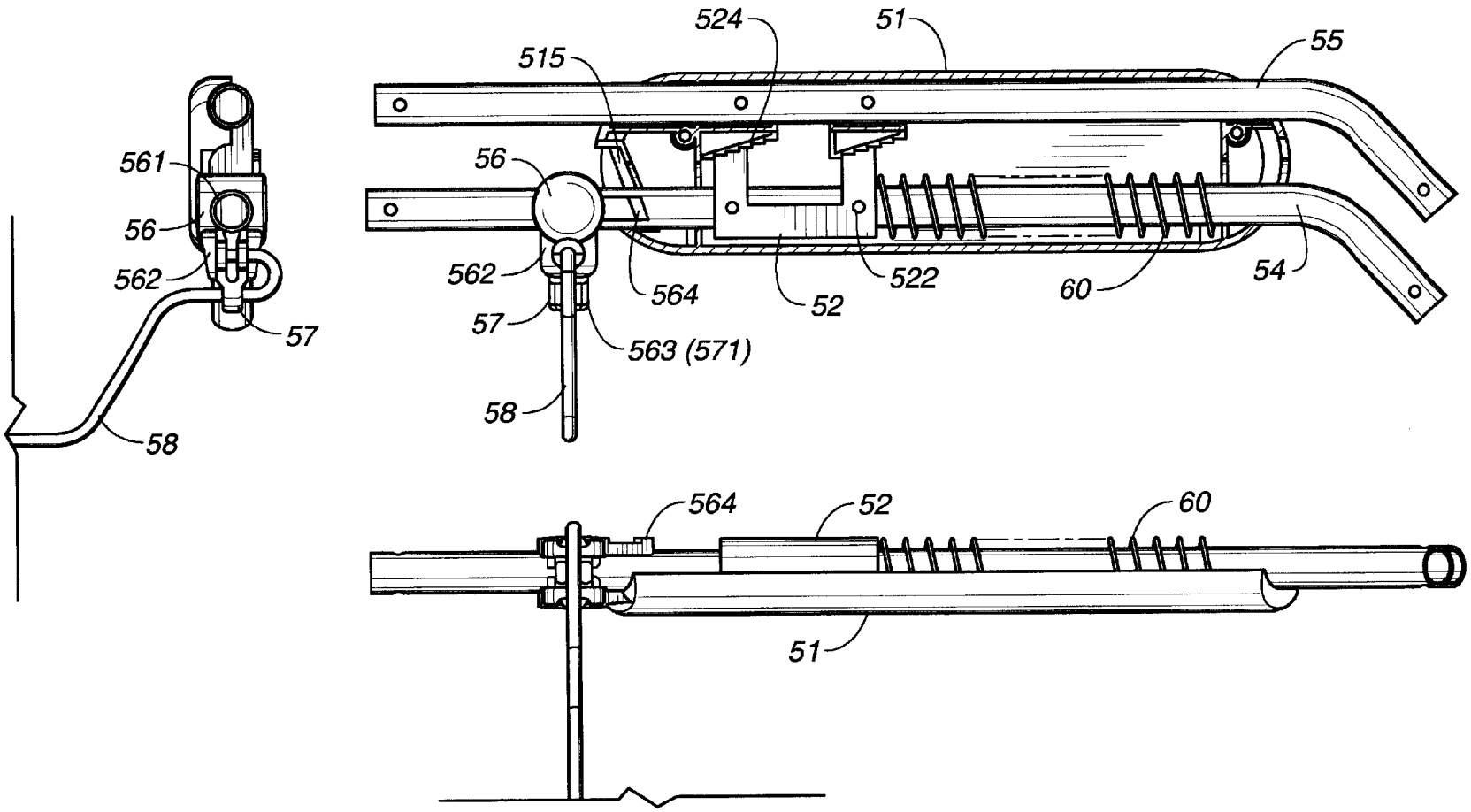
FIG. 3 is a three-phase view of the sectional partial structure of the invention.

In the slide (51) there is disposed a wedge phase (514) which matches another wedge phase (524) on the slant piece (52)(as shown in FIG. 3). The wedge phase (514) can either be a smooth slant phase or a stepped phase as shown in FIG. 3. The pressing spring (60) fixed between slant piece (52) and slide (51) maintains a force to push the two wedge phases up toward the higher position. As shown in FIG. 3. When the wedge phase (514) of the slide (51) on the parallel links (54, 55) is pushed by a spring (60), its right bigger end will lean against the link (54) tightly; that is, the distance between the two links (54, 55) will become longer. The slide (51) has a hook slot (515) in its left end. A lock catch (56) has a hook (564) on its end. The hook (564) is moveably set in the hook slot (515), the main body of look catch (56) shaped like a "U" has a rod hole (561) at the bottom of the "U" shaped slot for the link (54) to set in. On either side of the "U" slot there is disposed a clip panel 562 which has a pair of shaft holes (563). A brake piece (57) has a pair of shafts (571) which are pivoted in the shaft holes (563). The brake piece (57) controls its rotation by means of a draw bar (58) so as to release or brake the link (54) by means of the lock catch (56). When the lock catch (56) is locked, the distance between the parallel links (54,55) is fixed and maintained, as shown in FIG. 3. The slide (51) can not move left or right and cannot change the positioning angle between the two links (54,55); that is, it cannot change or adjust the height of the bracket table (30).

Figure 5:
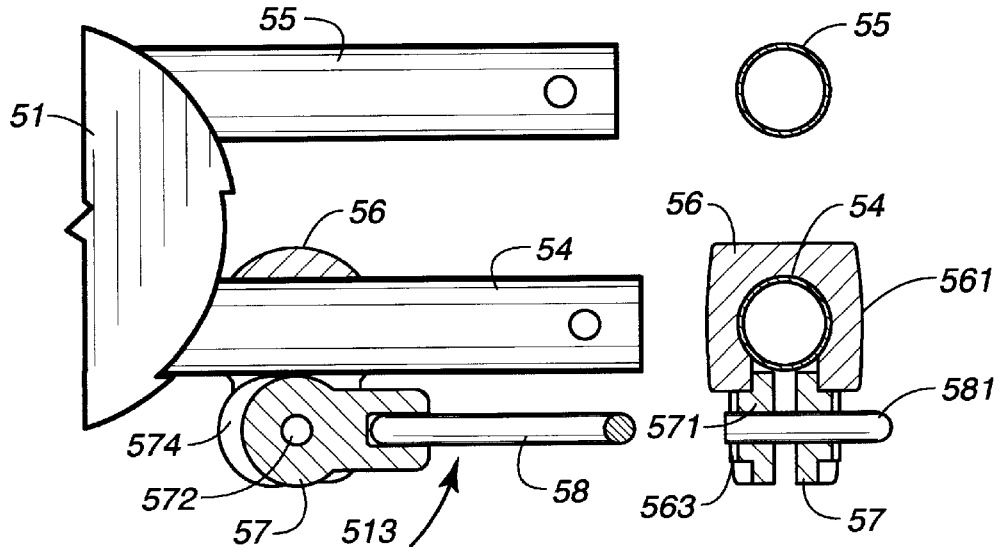
FIG. 5 is a schematic view of the lock catch of the invention in a released position.
Figure 6:
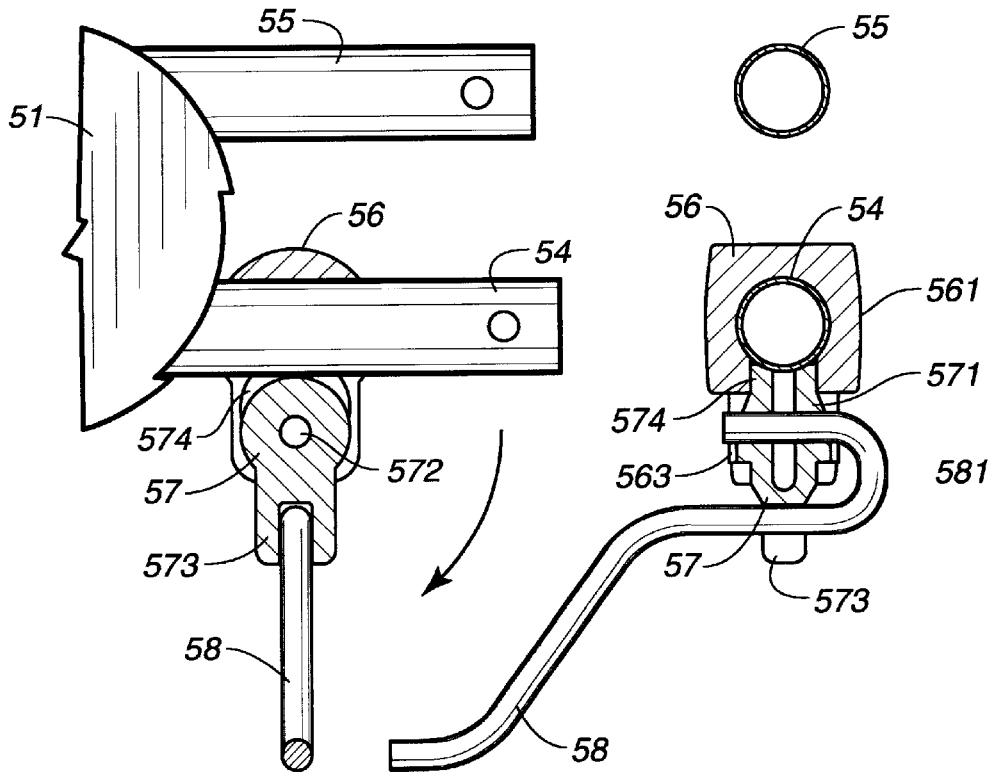
FIG. 6 is a schematic view of the lock catch of the invention in engagement a tightened position.

As shown in FIGS. 5 and 6, the brake piece (57) has a protruded brake gear (574) at its end. At the other end, there is disposed a protruded swing bar with a slot (573). Its convex shaft (571) has a penetrated hole (572). The end of the draw bar (58) is bent into a shape like a "U". The end of the bent draw bar (58) is pivoted in the hole (572). A portion of the draw bar (572) is set in the slot (573) so that it can rotate with the rotation of the brake piece (57). As shown in FIG. 5, when draw bar (58) rotates the brake piece (57) to take the brake gear (574) off the link (54), the lock catch (56) and slide (51) will smoothly move and glide on the link (54).

When the draw bar (58) rotates the brake piece (57) back to push the brake gear (574) to hold the link (54) firmly (as shown in FIG. 6), the lock catch (56) and the slide (51) will be positioned and secured on the link (54).

Figures 4A, 4B, 4C, 4D:
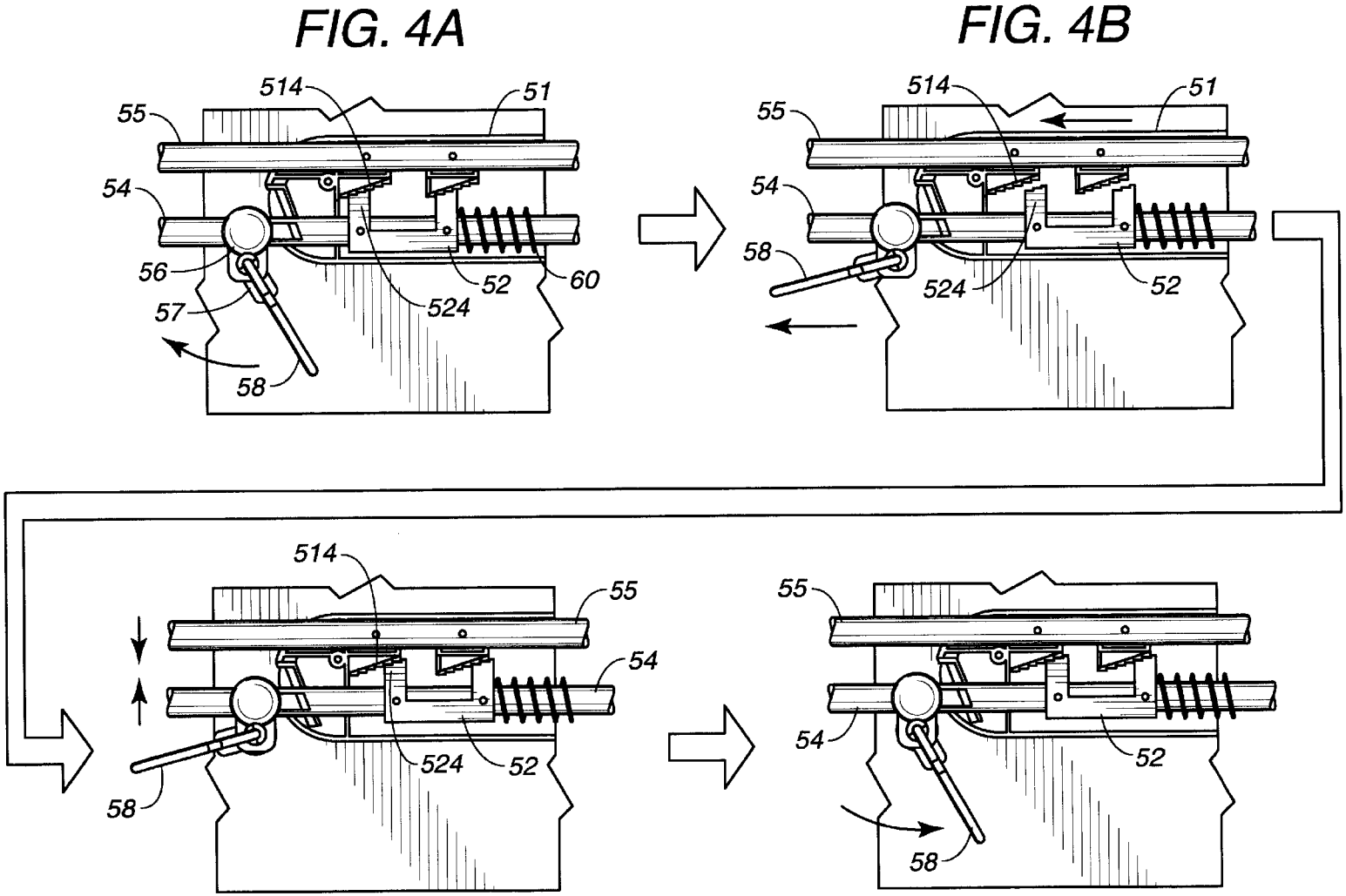
FIG. 4 is a schematic view of the invention in sequential operation (including FIG. 4-*a,* 4-*b,* 4-*c,* 4-*d*).

As shown in FIG. 4, the lifting gear (50) is in use. As shown in FIG. 4-A, the draw bar (58) is in motion and turns left from its locked position to the releasing position. When it is released, the bracket table (30) can be lifted at any time and the distance between the two links (54,55) becomes longer and longer, and the two wedge phases (514, 524) are lifted from the lower to the upper position by means of the spring (60) and it becomes a kind of one-way upward adjustment.

As shown in FIG. 4-B, when the draw bar (58) turns left to make the slide (51) move to the left to take the wedge phase (514) of the slide (51) apart from the wedge phase (524) of the slant piece (52), there will be a longer distance between the wedge phase (514) and the slant (or wedge) phase (524). As shown in FIG. 4-C, the coupled links (54,55) can be adjusted downward, and the distance between the two links (54, 55) is shortened until the two wedge phases (514,524) are very close to each other.

As shown in FIG. 4-D, the draw bar (58) can be pressed down back to its locking position. When the slide (51) is drawn to take the wedge phase (514) apart from the wedge phase (524) of the slide (2), the parallel link (54) will be pressed down to the lowest point and as a result, the baby walker (10) can be completely folded for storage.

The parallel lifting gear of this invention uses a draw bar (58)in the back of the baby walker to control the distance between the two links (54, 55) by means of a slide (54), a slant piece, and a lock catch so that it can be easily lifted. When the wedge piece receives great clipping pressure from the two links and because the wedge phase is stepped, more stepped phases can be provided to make the stepped sections more delicate and numerous so that it can be more easily and conveniently adjusted.

What is claimed is:

1. A baby walker comprising:

a chassis;

a bracket table; and a lifting gear means for elevating said bracket table relative to said chassis, said lifting gear means comprising:

two pairs of parallel links each having one end pivotally attached by a shaft pin to said chassis and an opposite end pivotally attached by a shaft pin to said bracket table, each of said two pairs of parallel links comprising:

a first link;

a second link;

a secured wedge piece fixed onto said first link, said secured wedge piece having a wedge phase with a wide end;

a slide having a rod slot slidably affixed to said second link, said slide having a wedge phase corresponding to said wedge phase of said secured wedge piece, said slide being resiliently urged by a spring toward said wide end of said wedge phase of said secured wedge piece; and a locking gear positioned between said first and second links so as to control a distance between said first and second links and to control a height of said bracket table with respect to said chassis, said locking gear comprising:

a lock catch having a "U"-shaped slot moveably positioned on said first link, said lock catch having a pair of clip panels disposed on said first link, said pair of clip panels having respective shaft holes extending therethrough;

a brake piece having a pair of shafts pivotally received by respective said shaft holes of said pair of clip panels;

a pair of brake gears coupled with said brake piece at one end of said brake piece;

a swing bar protruding from an opposite side of said brake piece; and a secured draw bar coupled to said swing bar, said slide having a hook slot coupled to a hook affixed to said lock catch, said draw bar being coupled to said lock catch and said slide such that a height of said bracket table is adjustable relative to movement of the wedge phases with respect to each other.

2. The baby walker of claim 1, said slide being a cover, said slide having a flange surface having a pair of parallel rod slots formed therein, one of said parallel rod slots having an elongated hole which receives a slanted piece of said secured wedge, said spring being affixed to said second link and between said secured wedge piece and said slide, said slide covering said secured wedge piece and said spring.

* * * * *